United States Patent [19]

Adolphson

[11] Patent Number: 4,901,385

[45] Date of Patent: Feb. 20, 1990

[54] ADJUSTABLE THERAPEUTIC LEG SUPPORT DEVICE

[76] Inventor: Emil E. Adolphson, 117 Briar La., North Aurora, Ill. 60542

[21] Appl. No.: 364,245

[22] Filed: Jun. 9, 1989

[51] Int. Cl.[4] ..... A47C 20/08

[52] U.S. Cl. ..... 5/443; 297/438

[58] Field of Search ..... 5/443, 444, 431, 437; 269/328; 128/80 A, 80 R, 878, 882; 297/439, 438

[56] References Cited

U.S. PATENT DOCUMENTS

| | | | |
|---|---|---|---|
| D. 139,504 | 11/1944 | Sadler | 297/439 |
| 1,118,973 | 12/1914 | Troesch | 5/443 |
| 2,244,440 | 6/1941 | Archer | 297/439 |
| 2,248,369 | 7/1941 | Ludersen | 297/439 |
| 2,384,234 | 9/1945 | Breese | 297/438 |
| 2,722,642 | 11/1955 | Dempster | 5/443 |
| 2,884,991 | 5/1959 | Bloomquist | 297/438 |
| 2,914,116 | 11/1959 | Gohmann | 297/439 |
| 3,005,662 | 10/1961 | Emery | 297/438 |
| 4,432,108 | 2/1984 | Chapman | 5/443 |
| 4,473,913 | 10/1984 | Ylvisaker | 5/443 |

FOREIGN PATENT DOCUMENTS

| | | | |
|---|---|---|---|
| 77120 | 1/1960 | France | 5/443 |
| 1278370 | 1/1961 | France | 297/439 |

*Primary Examiner*—Alexander Grosz

*Attorney, Agent, or Firm*—Lee, Mann, Smith, McWilliams & Sweeney

[57] ABSTRACT

An adjustable therapeutic leg support device is provided including a pair of vertical end panels spaced parallel to one another, each end panel having a plurality of apertures. An upper and a lower leg support panel extend transversely between said end panels. A pivotal hinge connects one edge of the upper leg support panel to one edge of the lower leg support panel and has a hinge rod extending through the hinge and through an opposing aperture in each end panel. An upper leg adjusting rod extending through and between opposing apertures in each end panel upon which a portion of the upper leg support panel rests. A lower leg adjusting rod extends through and between opposing apertures in each end panel upon which a portion of the lower leg support panel rests. The hinge rod and the two adjusting rods are independently positionable in any pair of desired apertures contained in the end panels allowing the height of the support panels to be fully adjustable and the angle of each support panel to be fully adjustable, all independently of one another.

17 Claims, 2 Drawing Sheets

ADJUSTABLE THERAPEUTIC LEG SUPPORT DEVICE

BACKGROUND OF THE INVENTION

The present invention relates to a leg support device used for the relief of lower back pain and discomfort or for simply relaxation. Lower back pain and discomfort have been found to be relieved in many cases where a person lies in a supine position with his upper and lower legs supported in an elevated position. When the upper leg is supported at an upward angle and the knee is sufficiently elevated, traction will be created between the legs and the lower back, thereby relieving pressure to the lumbar vertabrae and relieving lower back pain associated therewith. The angle of the upper leg and the elevation of the knee joint may be prescribed for an individual by a person such as a physical therapist or orthopedic surgeon, or may be determined by the individual user based simply upon what feels good. While the angle of the upper leg and the elevation of the knee are important to the proper flexing of the spine, the angle at which the lower leg is supported is also important for the individual's comfort in the use of the leg support device.

Various devices have been utilized to support a person's legs and thereby position and relieve pressure to the spine. However, many of these previous devices utilize a preselected and unadjustable upper leg support angle, knee joint elevation and lower leg support angle. In other devices one or both of the leg support angles will be determined by the selection of the knee joint elevation. Similarly, in prior devices the selection of the upper leg support angle will determine the knee joint elevation and may even determine the lower leg support angle. Such devices are shown in U.S. Pat. Nos. D.139,504; 2,244,440; 2,384,234; 2,884,991; 2,914,116; 3,005,662; 4,432,108; and 4,473,913. None of these devices discloses a leg support device in which the knee joint elevation, the upper leg support angle and the lower leg support angle are adjustable independently from one another without affecting each other.

SUMMARY OF THE INVENTION

The present invention provides for a leg support device for placing an individual user's legs in an elevated position while the person is lying on his back thereby creating traction between the user's legs and lower back. An upper leg support panel and a lower leg support panel are pivotally hinged together at a respective edge and extend transversely between a pair of end panels, each end panel having a plurality of apertures. A preselected knee joint elevation is obtained by placing the hinge between two opposing apertures in the end panels, which will provide the proper elevation. A hinge rod is inserted through the hinge and through the opposing apertures thereby pivotally supporting the hinged edges of both support panels. Each support panel may then be pivoted independently of one another to a desired angle. An adjusting rod is then inserted through opposing apertures in each end panel upon which the support panel will rest at the desired angle. The present leg support device thereby allows for the independent adjustment of the knee joint elevation, the upper leg support angle and the lower leg support angle, any one of which may be adjusted without affecting the other two.

DESCRIPTION OF THE PREFERRED EMBODIMENT

Figure 1:
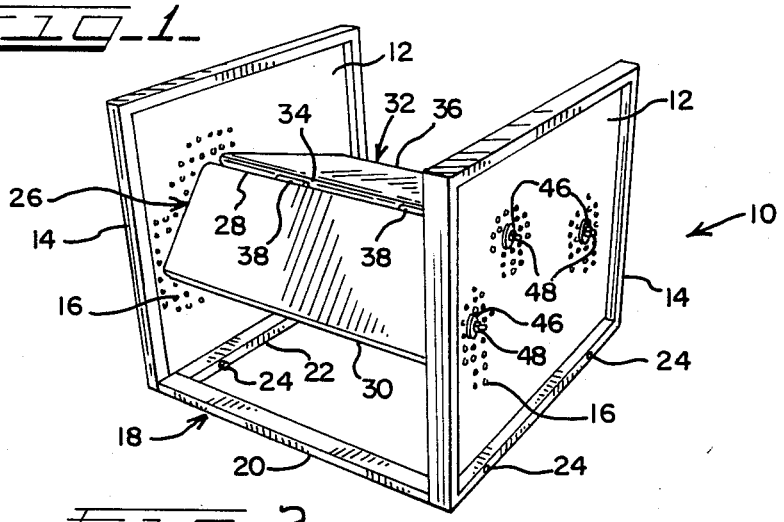
FIG. 1 is a perspective view of the leg support device of the present invention.
Figure 2:
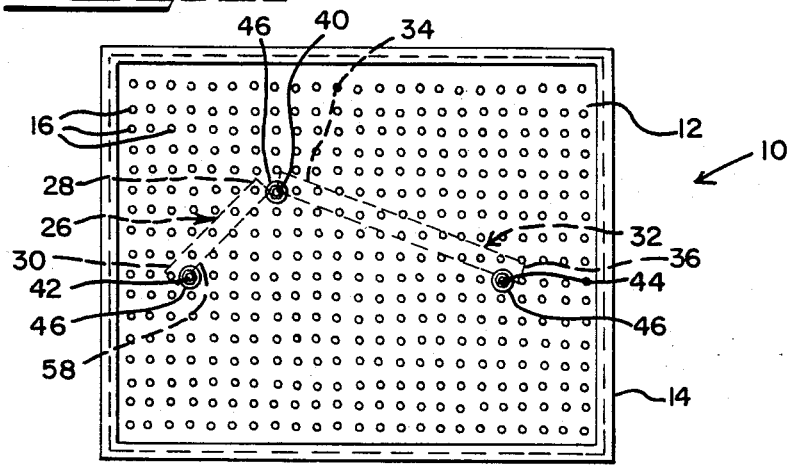
FIG. 2 is a side elevational view of the leg support device of the present invention.
Figure 3:
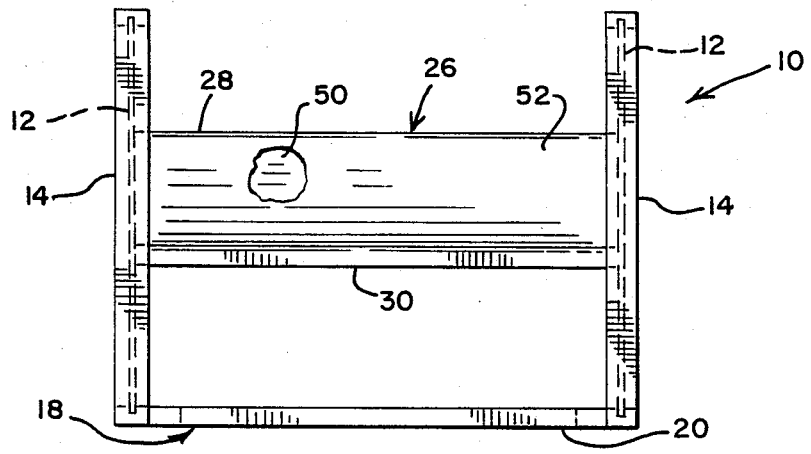
FIG. 3 is a front elevational view of the leg support device of the present invention.

The adjustable leg support device 10 includes a pair of vertical end panels 12. The end panels 12 are contained within end panel frames 14, each of which surround the perimeter of a respective end panel 12. The end panels 12 each contain a plurality of apertures 16. The apertures 16 are ¼ inch in diameter, although larger or smaller diameters may be used. The apertures 16 are arranged in a rectangular grid pattern with the apertures 16 being spaced apart a distance of 1 inch, center to center, in both the vertical and horizontal directions. Alternatively, larger or smaller center to center distances may be used, and the horizontal spacing may differ from the vertical spacing. The apertures 16 may also be placed in patterns other than a rectangular grid pattern. The end panels 12 are made of hardboard or plastic and are approximately ¼ inch thick, 19 inches high and 24 inches long. Naturally, larger or smaller sizes of end panels 12 may be used depending on the size of the user and the amount of adjustment desired. The end panel frames 14 are made of wood or plastic and are 1½ inches wide and are ¾ inch thick having a ⅜ inch deep slot into which the end panel 12 is inserted.

The end panels 12 are rigidly spaced parallel to one another by a base frame 18. The base frame 18 consists of two opposing end members 20 and two opposing side members 22 connected end to end in a rectangular shape. The bottom of each end panel frame 14 is attached to a respective side member 22 of the base frame 18 by fasteners 24. The base frame 18 is of sufficient size to extend the length of the end panel frames 14 and to space the end panels 14 apart from one another by approximately 23 inches, although a larger or smaller distance of separation may be used. The end panels 12 are located so that the apertures 16 in one end panel 12 will oppose a respective aperture 16 in the other end panel 12 in a direction which is perpendicular to the plane of each end panel 12.

An upper leg support panel 26, having a first edge 28 and a second edge 30, extends transversely between the end panels 12. A lower leg support panel 32, having a first edge 34 and a second edge 36, also extends transversely between the end panels 12. The first edge 28 of the upper leg support panel 26 is pivotally connected to the first edge 34 of the lower leg support panel 32 by hinge 38. The hinge 38 has a hinge rod 40 which removably extends through the hinge 38 and through a pair of opposing apertures 16 in the end panels 12. An upper leg adjusting rod 42 extends through a second pair of opposing apertures 16 in the end panels 12 and supports the second end 30 of the upper leg support 26. A lower leg adjusting rod 44 extends through a third pair of opposing apertures 16 in the end panels 12 and supports the second end 36 of the lower leg support panel 32. The rods 40, 42 and 44 are completely threaded or may be threaded only at each end. The rods 40, 42 and 44 are ¼ inch in diameter, but may be larger or smaller as would be understood, and are of sufficient length to allow washer 46 and a threaded are a fastener 48 to be fastened to each end of the rods 40, 42 and 44 on the outside of the end panels 12.

The support panels 26 and 32 are made of wood, are ⅝ inch thick and are of sufficient length to span the distance between the end panels 12. The upper leg support panel is approximately 8 inches wide between the first edge 28 and second edge 30. The width of the lower leg support 32 is approximately 15 inches between first edge 34 and second edge 36. The widths of the support panels 26 and 32 of course may be varied and may be sized to fit a particular user. The width of the lower leg support panel 32 however should be short enough so that the second edge 36 is located above the user's ankles thereby allowing the user's lower legs 57 to lie flat on the lower leg support panel 32. The support panels 26 and 32 are covered with a light padding 50. The padding 50 should not be too soft so as to lessen the effectiveness of the support provided by the leg support 10. The padding 50 is covered with a cloth covering 52. While other materials such as vinyl may be used, cloth is preferred to add to the traction qualities of the leg support device 10 as a result of friction.

Figure 4:
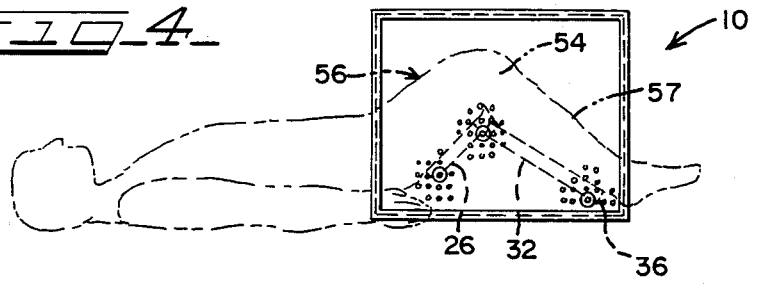
FIG. 4 is a side elevational view of the leg support device shown in use with the support panels in one of many possible orientations.
Figure 5:
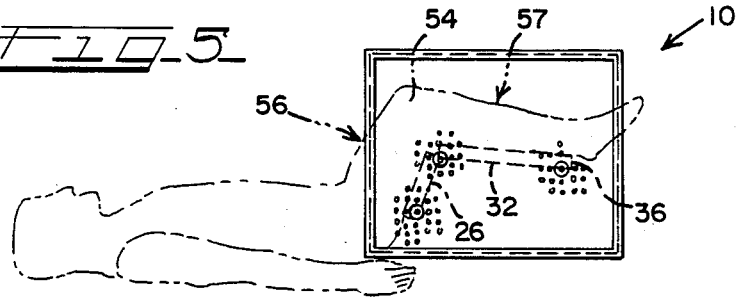
FIG. 5 a side elevational view of the leg support device shown in use with the support panels in a second of many possible orientations.
Figure 6:
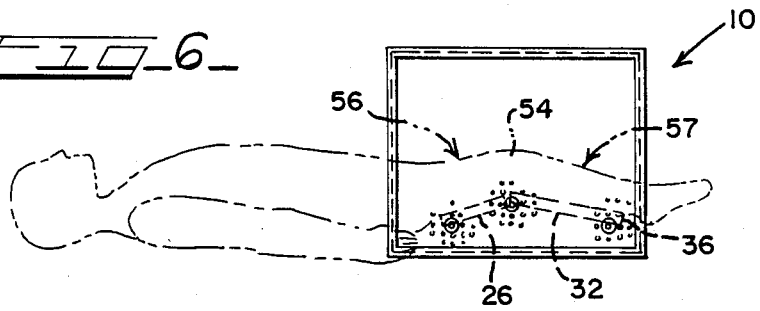
FIG. 6 is a side elevational view of the leg support device shown in use with the support panels in a third of many possible orientations.

The hinge rod 40 is placed through the hinge 38 and through a selected pair of opposing apertures in the end panels 12 which will place the knee joint 54 at the desired elevation. The upper leg support 26 is then pivoted to the desired inclination with respect to horizontal to provide support for the upper leg 56. The pair of opposing apertures 16 having their centers the closest to the underside 58 of the upper leg support panel 26 are selected for the insertion of the upper leg adjusting rod 42. The adjusting rod 42 is inserted through the selected apertures !6 so that the upper leg support 26 will rest upon and be supported by the adjusting rod 42. Washers 46 and threaded fasteners 48 are then fastened to each end of the upper leg adjusting rod 42. The upper leg adjusting rod 42 thereby supports the second end 30 of the upper leg support panel 26 at the desired angle with the horizontal. The lower leg support panel 32 is then pivoted to the desired inclination with respect to horizontal to provide support to the lower leg 57 and is supported at the desired inclination by the insertion of the lower leg adjusting rod 44 into a selected pair of opposing apertures 16 as is done with the upper leg support panel 26. FIGS. 4–6 show but a few of the many possible orientations in which the support panels 26 and 32 may be placed. The elevation of the knee joint 54 may be adjusted vertically upward or downward a desired distance by inserting the hinged rod 40 into a new pair of opposing apertures 16 which are the closest to the desired distance above or below the original position of the hinged rod 40. The adjusting rods 42 and 44 may be moved up or down the same distance as the hinge rod 40 to maintain the original angle between support panels 26 and 32. Alternatively, one or both of the support panels 26 and 32 may be individually adjusted, while maintaining the elevation of the knee joint 54 constant, by respectively moving the adjustment rods 42 or 44 a desired distance, horizontally and/or vertically, to a new pair of opposing apertures 16. If finer elevational adjustment and/or angular adjustment is desired, end panels 12 may be provided to have apertures 16 centered at a smaller spacing.

Figure 7:
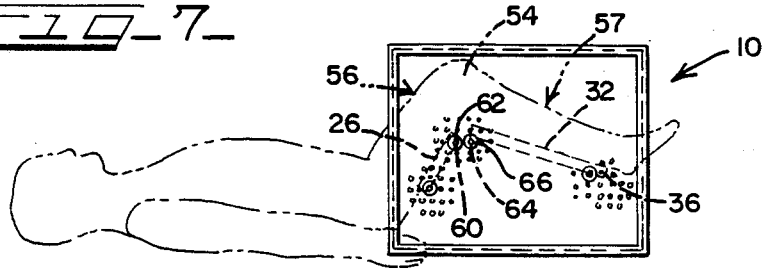
FIG. 7 is a side elevational view of a second embodiment of the leg support device shown in use.

A second embodiment of the adjustable leg support device 10 is shown in FIG. 7. In this embodiment the upper leg support panel 26 is not hingedly connected to the lower leg support panel 32. The upper leg support panel 26 has a hinge 60 located at its first edge 28. A first hinge rod 62 is inserted through hinge 60 and extends through a selected pair of opposing apertures 16 in the end panels 12. The lower leg support panel 32 also has a hinge 64 located at its first edge 34 through which a second hinge rod 66 is inserted and extends through a second selected pair of opposing apertures 16 in end panels 12. In this embodiment the elevation of the first edge 28 of the upper leg support panel 26 and the elevation of the first edge 34 of the lower leg support panel 32 are independently adjustable. The horizontal distance between the first edge 28 and first edge 34 of the support panels 26 and 32 is also adjustable. Once the first and second hinge rod 62 and 66 have been inserted into their selected pairs of opposing apertures 16, the inclinations of the support panels 26 and 32 are adjusted as in the first embodiment.

Various features of the invention have been particularly shown and described in connection with the illustrated embodiment of the invention, however, it must be understood that these particular arrangements merely illustrate and that the invention is to be given its fullest interpretation within the terms of the appended claims.

What is claimed is:

1. An adjustable leg support comprising:

a frame having panel support means;

an upper leg support panel adjustably supported at said panel support means at an elevation and at an inclination with respect to horizontal, a lower leg support panel adjustably supported at said panel support means at an elevation and at an inclination with respect to horizontal said upper leg support panel being separate and distinct from said lower leg support panel and also being angularly adjustable relative to said lower leg support panel.

2. The adjustable leg support of claim 1 wherein said upper leg support panel and said lower leg support panel are hingedly joined at hinge means.

3. The adjustable leg support of claim 1 wherein said upper leg support panel and said lower leg support panel have attachment means independently supported at said panel support means.

4. The adjustable leg support of claim 1 wherein the upper leg support panel and said lower leg support panel are rectangular and the width of the rectangular upper leg support panel is less than the lower leg support panel width.

5. An adjustable leg support comprising:

a pair of vertical end panels spaced parallel to one another, each said end panel including a plurality of apertures;

an upper leg support panel extending transversely between said end panels, said upper leg support panel having a hinged end and a free end;

a lower leg support panel extending transversely between said end panels, said lower leg support having a hinged end and a free end;

a hinge pivotally connecting said hinged end of said upper leg support panel to said hinged end of said lower leg support panel, said hinge including a removable hinge rod which extends through said hinge and through opposing apertures in said end panels for pivotally supporting said hinged ends of said upper and lower leg support panels;

an upper leg adjusting rod removably extending through opposing apertures in said end panels and supporting said free end of said upper leg support panel;

a lower leg adjusting rod removably extending through opposing apertures in said end panels and supporting said free end of said lower leg support panel;

said hinge rod, upper leg adjusting rod and lower leg adjusting rod being independently positionable, vertically and/or horizontally, from one another, allowing the elevation of said hinged ends of said support panels and the inclination of each said support panel to be independently adjustable.

6. The leg support of claim 5 wherein said hinge rod, said upper leg adjusting rod and said lower leg adjusting rod are threaded.

7. The leg support of claim 5 including a frame rigidly positioning each said end panel parallel to one another.

8. The leg support of claim 5 including a covering material located on said support panels.

9. The leg support of claim 8 including a padding material located between said support panels and said covering material.

10. The leg support of claim 5 wherein the centers of said apertures are located in a rectangular grid pattern.

11. An adjustable leg support comprising:

a pair of vertical end panels spaced parallel to one another, each said end panel including a plurality of apertures;

an upper leg support panel extending transversely between said end panels, said upper leg support panel having a hinged end and a free end;

a lower leg support panel extending transversely between said end panels, said lower leg support panel having a hinged end and a free end;

a first hinge fastened to said hinged end of said upper leg support panel, said first hinge including a removable first hinge rod which extends through said first hinge and through an opposing aperture in each of said end panels for pivotally supporting said hinged end of said upper support leg panel;

a second hinge fastened to said hinged end of said lower leg support panel, said second hinge including a removable second hinge rod which extends through said second hinge and through an opposing aperture in each of said end panels for pivotally supporting said hinged end of said lower leg support panel;

an upper leg support adjusting rod removably extending through an opposing aperture in each of said end panels and supporting said free end of said upper leg support panel;

a lower leg adjusting rod removably extending through an opposing aperture in each of said end panels and supporting said free end of said lower leg support panel;

each said first hinge rod, second hinge rod, upper leg adjusting rod and lower leg adjusting rod being independently positionable, vertically and/or horizontally, allowing the elevation and inclination of each said support panel to be independently adjustable.

12. The leg support of claim 11 wherein said first hinge rod, said second hinge rod, said upper leg adjusting rod and said lower leg adjusting rod are threaded.

13. The leg support of claim 11 including a frame rigidly positioning each said end panel parallel to one another.

14. The leg support of claim including a covering material located on said support panels.

15. The leg support of claim 14 including a padding material located between said support panels and said covering material.

16. The leg support of claim 11 wherein the centers of said apertures are located in a rectangular grid pattern.

17. An adjustable leg support comprising:

a frame having panel support means;

two leg support panels forming an eagle there between and supported by said panel support means at opposite ends of said panels;

means for adjusting the angle between the panels;

one said panel being an upper leg support panel and the other being a lower leg support panel, said panels each having two sides arrange to be transverse to the user's legs and said panel support frame means support said panels whereby to place one side of one panel sufficiently close to one side of the other support panel in order for said close sides to be able to reside generally underneath a user's knee joint, and the other two remaining panel sides being spaced therefrom at opposite sides of said knee joint whereby one of said remaining sides is arranged to be able to reside along the user's upper leg and the other of said remaining sides arranged to be able to reside along a user's lower leg;

said means for adjusting the angle between the panels being pivotally arranged with at least one of said closer sides of said panels and whereby upon pivoting thereat said angle may be adjusted; and, said panel support means adjustably and removably engaging said panels to the frame.

* * * * *

UNITED STATES PATENT AND TRADEMARK OFFICE

CERTIFICATE OF CORRECTION

PATENT NO. : 4,901,385

DATED : February 20, 1990

INVENTOR(S) : Emil E. Adolphson

It is certified that error appears in the above-identified patent and that said Letters Patent is hereby corrected as shown below:

In Claim 17, column 6, line 33, please delete the word "eagle" and insert therefor - - angle - - .

Signed and Sealed this

Thirtieth Day of July, 1991

*Attest:*

HARRY F. MANBECK, JR.

*Attesting Officer*

*Commissioner of Patents and Trademarks*